US011091921B2

(12) United States Patent
Maziarz

(10) Patent No.: US 11,091,921 B2
(45) **Date of Patent: *Aug. 17, 2021**

(54) STOP BEAD FOR PANEL-BASED SIDING, AND RELATED METHODS AND SYSTEMS

(71) Applicant: E-Z BEAD, LLC, Royersford, PA (US)

(72) Inventor: Jeffrey Maziarz, Royersford, PA (US)

(73) Assignee: E-Z BEAD, LLC, Royersford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/848,622

(22) Filed: Apr. 14, 2020

(65) Prior Publication Data

US 2020/0240153 A1 Jul. 30, 2020

Related U.S. Application Data

(63) Continuation-in-part of application No. 16/137,340, filed on Sep. 20, 2018, now Pat. No. 10,648,184.

(60) Provisional application No. 62/562,282, filed on Sep. 22, 2017, provisional application No. 62/583,242, filed on Nov. 8, 2017, provisional application No. 62/627,067, filed on Feb. 6, 2018, provisional application No. 62/630,600, filed on Feb. 14, 2018, provisional application No. 62/840,212, filed on Apr. 29, 2019.

(51) Int. Cl.
*E04C 2/38* (2006.01)
*E04F 19/06* (2006.01)

(52) U.S. Cl.
CPC ..... *E04F 19/06* (2013.01)

(58) Field of Classification Search
None
See application file for complete search history.

(56) References Cited

U.S. PATENT DOCUMENTS

| | | | |
|---|---|---|---|
| 517,701 A | 4/1894 | Knower | |
| 1,030,044 A | 6/1912 | Whittbecker | |
| 1,361,843 A | 12/1920 | Flagge | |
| 1,386,509 A | 8/1921 | Kirmes | |

(Continued)

FOREIGN PATENT DOCUMENTS

| | | | |
|---|---|---|---|
| DE | 2455775 | 8/1976 | ..... E04F 15/14 |
| DE | 2538412 | 3/1977 | ..... E04F 15/14 |

(Continued)

OTHER PUBLICATIONS

Notice of Allowance issued in U.S. Appl. No. 11/981,421, dated Sep. 8, 2010 (6 pgs).

(Continued)

*Primary Examiner* — Basil S Katcheves
(74) *Attorney, Agent, or Firm* — Hayes Soloway P.C.

(57) ABSTRACT

Embodiments of the present disclosure provide an apparatus, system and method for creating an airtight seal between a jamb and a siding panel on an exterior wall. An apparatus for creating an airtight seal between a jamb and a siding panel on an exterior wall comprises a stop bead running a length of the jamb. The stop bead has an at least partially flexible spacing strip and a rigid base panel. The rigid base panel is positioned to lay flat against the exterior wall. The at least partially flexible spacing strip is attached to an edge of the rigid base panel, and wherein the at least partially flexible spacing strip maintains a seal against the jamb.

20 Claims, 12 Drawing Sheets

(56) References Cited

U.S. PATENT DOCUMENTS 1,673,971 A 6/1928 Dowell
1,679,914 A 8/1928 Murray
1,840,221 A 1/1932 Bridges
1,886,320 A 11/1932 Waite
1,956,809 A 5/1934 Robertson
2,031,249 A 2/1936 Bowman
2,151,605 A 3/1939 Lavering
2,189,216 A 2/1940 Mathias
2,198,084 A 4/1940 Jacobson
2,272,162 A 2/1942 Lackey
2,286,890 A 6/1942 Birt
2,405,844 A 8/1946 Mortenson
2,645,824 A 7/1953 Titsworth ..... E04B 1/7069
2,725,608 A 12/1955 Parslow
2,732,045 A 1/1956 Herlocker
2,742,120 A 4/1956 Rosebrook
2,845,666 A 8/1958 Knapp
RE24,658 E 6/1959 Hollister
2,904,992 A 9/1959 Cruser
2,953,835 A 9/1960 Armstrong
3,192,577 A 7/1965 Barr
3,201,908 A 8/1965 Arnold
3,213,577 A 10/1965 Levin
3,314,201 A 4/1967 Riegelman
3,319,384 A 5/1967 Berg
3,320,707 A 5/1967 Berg ..... E04D 3/366
3,343,323 A 9/1967 Mayfield ..... 545/254
3,344,720 A 10/1967 Hallock ..... E01D 19/06
3,349,519 A 10/1967 Nehlig
3,398,494 A 8/1968 Larson
3,421,267 A 1/1969 Reiff ..... E04D 13/1415
3,425,172 A 2/1969 Attaway ..... E04D 13/1415
3,486,283 A 12/1969 Arnett
3,509,674 A 5/1970 Birum, Jr.
3,512,318 A 5/1970 Turner
3,608,254 A 9/1971 Sklamberg
3,619,944 A 11/1971 Matvey
3,638,372 A 2/1972 Rosenthal ..... 52/97
3,667,174 A 6/1972 Arnett
3,670,470 A 6/1972 Thom ..... E04D 13/151
3,765,138 A 10/1973 Bentle
3,782,680 A 1/1974 Hopkins
3,813,180 A 5/1974 O'Brill
3,849,958 A 11/1974 Balzer ..... E04B 1/6804
3,871,787 A 3/1975 Stegmeier
3,922,826 A 12/1975 Molyneux
3,964,220 A 6/1976 Rutkowski
3,974,609 A 8/1976 Attaway ..... E04B 1/6804
4,038,791 A 8/1977 Atkinson
4,111,583 A 9/1978 Brady ..... E01D 19/06
4,271,650 A 6/1981 Lynn-Jones ..... E04B 1/6804
4,295,315 A 10/1981 Lynn-Jones ..... E04B 1/6804
4,359,847 A 11/1982 Schukolinski ..... E04B 1/6804
4,505,079 A 3/1985 Black
4,545,162 A 10/1985 Attaway
4,651,488 A 3/1987 Nicholas
4,663,883 A 5/1987 Hilliard
4,726,148 A 2/1988 Tix
4,763,455 A 8/1988 Schneller
4,774,795 A 10/1988 Braun
4,781,004 A 11/1988 Hartman
4,784,516 A 11/1988 Cox
4,785,601 A 11/1988 Tupman
4,829,731 A 5/1989 Schluter
4,833,851 A 5/1989 Ohmatsu ..... E04B 1/6804
4,841,704 A 6/1989 Jarrell
4,984,402 A 1/1991 Davies ..... 52/398
5,014,471 A 5/1991 Ballstadt
5,042,211 A 8/1991 Nestler
5,073,430 A 12/1991 Aidan
5,127,204 A 7/1992 Braun
5,181,357 A 1/1993 Pourtau
5,210,986 A 5/1993 Hagemeyer
5,222,343 A 6/1993 Anderson
5,230,738 A 7/1993 Wheeler
5,305,566 A 4/1994 Larkowski
5,313,755 A 5/1994 Koenig, Jr.
5,333,432 A 8/1994 Schluter
5,338,130 A 8/1994 Baerveldt
5,365,713 A 11/1994 Nicholas ..... E04B 1/681
5,384,996 A 1/1995 Nicholas ..... E04B 1/681
5,406,758 A 4/1995 Baum ..... 249/6
5,423,154 A 6/1995 Maylon
5,430,981 A 7/1995 Scott
5,450,699 A 9/1995 Lee
D364,233 S 11/1995 Caley
5,519,969 A 5/1996 Golba ..... 52/60
5,544,445 A 8/1996 Mantilla
5,551,201 A 9/1996 Anderson
5,560,166 A 10/1996 Burke ..... F16J 15/065
5,575,126 A 11/1996 Attaway ..... E04B 1/6804
5,579,623 A 12/1996 Stark
5,607,253 A 3/1997 Almstrom
5,671,571 A 9/1997 Braun
5,694,723 A 12/1997 Parker ..... E02D 27/32
5,699,638 A 12/1997 Maylon
5,790,671 A 4/1998 Cooper
5,761,866 A 6/1998 Maylon
5,791,111 A 8/1998 Beenders ..... E04B 1/6804
5,791,116 A 8/1998 Skintzis
5,836,135 A 11/1998 Hagan ..... E04B 1/762
5,937,600 A 8/1999 Larson ..... E04B 1/762
5,946,870 A 9/1999 Bifano et al. ..... 52/254
5,950,370 A 9/1999 Peck
5,970,671 A 10/1999 Bifano et al. ..... 52/254
6,018,924 A 2/2000 Tamlyn
6,052,959 A 4/2000 LaBrosse ..... E04B 1/7076
6,102,407 A 8/2000 Moriya et al.
6,119,416 A 9/2000 Larson
6,122,883 A 9/2000 Braun
6,131,352 A 10/2000 Barnes ..... E04B 1/948
6,223,486 B1 5/2001 Dunham
6,293,064 B1 9/2001 Larson ..... 52/302.1
6,298,609 B1 10/2001 Bifano
6,308,475 B1 10/2001 Crish, II
6,322,045 B1 11/2001 Andros
6,338,229 B1 1/2002 Botzen
D456,528 S 4/2002 Maylon
6,367,210 B1 4/2002 Trundle
6,385,932 B1 5/2002 Melchiori ..... 52/302.3
6,410,118 B1 6/2002 Reicherts ..... B32B 13/04
6,425,216 B1 7/2002 Gardner
6,470,638 B1 10/2002 Larson ..... E04B 1/765
6,490,831 B1 12/2002 Candusso
D471,991 S 3/2003 Maylon
6,527,467 B2 3/2003 Betts ..... E01D 19/065
6,598,360 B1 7/2003 Pratt ..... E02D 31/02
6,609,341 B2 8/2003 Maylon et al. ..... 52/367
6,631,595 B1 10/2003 Minter
6,698,144 B1 3/2004 Larson ..... E04B 1/765
6,705,047 B2 3/2004 Yulkowski
6,745,531 B1 6/2004 Egan ..... E04B 1/70
7,406,805 B1 8/2008 Larson
7,458,190 B2 12/2008 Isaac et al.
7,526,897 B2 5/2009 Collins
7,634,883 B1 12/2009 Larson
7,673,421 B2 3/2010 Pilz ..... E04D 1/36
7,874,123 B2 1/2011 Maziarz
8,132,380 B2 3/2012 Wilkes, Jr.
8,561,367 B2 10/2013 Kelly ..... E04D 3/405
8,578,660 B2 11/2013 Nolan et al. ..... 52/62
8,615,944 B2 12/2013 Maziarz
8,646,235 B2 2/2014 Hilburn ..... E04B 1/948
8,919,062 B1 12/2014 Viness et al. ..... 52/302.3
9,062,453 B1 6/2015 Maziarz ..... E04B 1/68
9,238,897 B2 1/2016 Nolan et al. ..... E02D 31/02
9,279,247 B2 3/2016 Maziarz ..... E04F 1/66
D762,310 S 7/2016 Apanovich ..... D25/119
9,797,142 B1 10/2017 Sacks ..... E04F 13/04
10,196,812 B1 2/2019 Duffy et al.
10,358,814 B2 7/2019 Maziarz ..... E04F 13/04
10,494,818 B2 12/2019 Maziarz ..... E04F 13/04
10,648,184 B2 * 5/2020 Maziarz ..... E04F 19/06
2002/0124504 A1 9/2002 Maylon

(56) References Cited

U.S. PATENT DOCUMENTS

| | | | | |
|---|---|---|---|---|
| 2003/0051422 | A1 | 3/2003 | Maziarz | |
| 2004/0020143 | A1 | 2/2004 | Webb | |
| 2004/0216414 | A1 | 11/2004 | Dickinson | 52/506.01 |
| 2005/0204653 | A1 | 9/2005 | Matthews | E02D 31/02 |
| 2006/0005472 | A1 | 1/2006 | Miller | E06B 7/18 |
| 2006/0150553 | A1 | 7/2006 | Reyes | E04F 13/06 |
| 2006/0277854 | A1 | 12/2006 | Egan | E04B 1/80 |
| 2007/0062137 | A1 | 3/2007 | Maylon | 52/367 |
| 2008/0104918 | A1 | 5/2008 | Gleeson | E04B 1/762 |
| 2008/0263971 | A1 | 10/2008 | Maziarz | 52/204.1 |
| 2009/0183453 | A1 | 7/2009 | Koessler | 52/302.3 |
| 2010/0257799 | A1 | 10/2010 | Johnson | E04F 13/0864 |
| 2011/0277394 | A1 | 11/2011 | Chich et al. | 52/95 |
| 2012/0174495 | A1 | 7/2012 | Nolan | E04F 19/045 |
| 2012/0324814 | A1 | 12/2012 | Amend | E04B 1/7645 |
| 2013/0205696 | A1 | 8/2013 | Little et al. | E04F 13/06 |
| 2014/0245676 | A1 | 9/2014 | Maziarz | E06B 1/62 |
| 2016/0069071 | A1 | 3/2016 | Remmele | E04B 2/02 |
| 2016/0186481 | A1 | 6/2016 | Maziarz | E06B 1/02 |
| 2017/0130462 | A1 | 5/2017 | Maziarz | E04F 13/06 |
| 2017/0254091 | A1 | 9/2017 | Friel | E04B 1/765 |
| 2017/0342709 | A1 | 11/2017 | Dahlin | E04B 1/64 |
| 2018/0112414 | A1 | 4/2018 | Maziarz | E06B 1/62 |
| 2019/0161960 | A1 | 5/2019 | Baltz, Jr. et al. | E04B 1/7076 |
| 2019/0186147 | A1 | 6/2019 | Baltz, Jr. et al. | E04D 13/158 |
| 2019/0194954 | A1 | 6/2019 | Baltz, Jr. et al. | E04F 19/04 |

FOREIGN PATENT DOCUMENTS

| | | | |
|---|---|---|---|
| DE | 3503395 | 8/1986 | E04B 1/68 |
| FR | 2307091 | 11/1976 | |
| FR | 2412236 | 7/1979 | |
| FR | 2507227 | 12/1982 | E04B 1/68 |
| SU | 1705521 | 1/1992 | |

OTHER PUBLICATIONS

Notice of Allowance issued in U.S. Appl. No. 12/152,046, dated Feb. 12, 2014 (16 pgs).
Notice of Allowance issued in U.S. Appl. No. 12/931,079, dated Aug. 21, 2013 (11 pgs).
Notice of Allowance issued in U.S. Appl. No. 14/275,757, dated Jan. 29, 2016 (5 pgs).
Notice of Allowance issued in U.S. Appl. No. 15/865,952, dated May 30, 2019 (4 pgs).
Notice of Allowance issued in U.S. Appl. No. 15/791,246, dated Oct. 25, 2019 (15 pgs).
Notice of Allowance issued in U.S. Appl. No. 16/137,340, dated Jan. 14, 2020 (14 pgs).
Office Action issued in U.S. Appl. No. 09/952,920, dated Jan. 22, 2003 (12 pgs).
Office Action issued in U.S. Appl. No. 09/952,920, dated Jan. 26, 2005 (9 pgs).
Office Action issued in U.S. Appl. No. 09/952,920, dated Jun. 22, 2004 (6 pgs).
Office Action issued in U.S. Appl. No. 09/952,920, dated Oct. 22, 2003 (7 pgs).
Office Action issued in U.S. Appl. No. 11/259,499, dated Aug. 28, 2008 (9 pgs).
Office Action issued in U.S. Appl. No. 11/259,499, dated Oct. 23, 2007 (6 pgs).
Office Action issued in U.S. Appl. No. 11/259,499, dated Sep. 7, 2006 (9 pgs).
Office Action issued in U.S. Appl. No. 11/981,421, dated Aug. 5, 2009 (6 pgs).
Office Action issued in U.S. Appl. No. 12/152,046, dated Feb. 28, 2011 (7 pgs).
Office Action issued in U.S. Appl. No. 12/152,046, dated Nov. 30, 2011 (6 pgs).
Office Action issued in U.S. Appl. No. 12/152,046, dated Nov. 2, 2012 (28 pgs).
Office Action issued in U.S. Appl. No. 12/931,079, dated Oct. 15, 2012 (29 pgs).
Office Action issued in U.S. Appl. No. 12/931,079, dated Sep. 23, 2011 (11 pgs).
Office Action issued in U.S. Appl. No. 14/275,721, dated Jul. 13, 2015 (8 pgs).
Office Action issued in U.S. Appl. No. 14/275,721, dated Sep. 29, 2014 (9 pgs).
Office Action issued in U.S. Appl. No. 14/275,757, dated Jul. 14, 2015 (8 pgs).
Office Action issued in U.S. Appl. No. 14/275,757, dated Sep. 29, 2014 (9 pgs).
Office Action issued in U.S. Appl. No. 15/062,876, dated Oct. 19, 2016 (17 pgs).
Office Action issued in U.S. Appl. No. 15/791,246, dated Apr. 16, 2018 (6 pgs).
Office Action issued in U.S. Appl. No. 15/791,246, dated Dec. 12, 2018 (20 pages).
Office Action issued in U.S. Appl. No. 15/791,246, dated Jul. 26, 2018 (26 pgs).
Office Action issued in U.S. Appl. No. 15/791,246, dated Jul. 3, 2019 (27 pgs).
Office Action issued in U.S. Appl. No. 15/865,952, dated Mar. 1, 2019 (8 pgs).
Office Action issued in U.S. Appl. No. 15/865,952, dated Oct. 11, 2018 (10 pgs).
Office Action issued in U.S. Appl. No. 16/137,340, dated Aug. 6, 2019 (35 pgs).
Office Action issued in U.S. Appl. No. 14/869,524, undated, 11 pages.
Office Action issued in Canadian application No. 2,983,532 dated Aug. 25, 2020 (3 pgs).
U.S. Appl. No. 16/137,340, filed Sep. 20, 2018.
U.S. Appl. No. 16/751,006, filed Jan. 23, 2020, Maziarz.
U.S. Appl. No. 17/208,954, filed Mar. 22, 2021, Maziarz.
Office Action issued in U.S. Appl. No. 16/751,006, dated Feb. 2, 2021, 45 pgs.
Notice of Allowance issued in Canadian application No. 2,983,532, 1 pg.
Office Action issued in U.S. Appl. No. 16/751,006, dated Jun. 25, 2001, 29 pgs.

* cited by examiner

STOP BEAD FOR PANEL-BASED SIDING, AND RELATED METHODS AND SYSTEMS

CROSS REFERENCE TO RELATED APPLICATION

This application claims benefit of U.S. Provisional Application Ser. No. 62/840,212 filed Apr. 29, 2019 and is a continuation-in-part of U.S. patent application Ser. No. 16/137,340 filed Sep. 20, 2018, which claims benefit of U.S. Provisional Application Ser. No. 62/562,282 filed Sep. 22, 2017, U.S. Provisional Application Ser. No. 62/583,242 filed Nov. 8, 2017, U.S. Provisional Application Serial No. 62/627,067 filed Feb. 6, 2018, and U.S. Provisional Application Ser. No. 62/630,600 filed Feb. 14, 2018, the entire disclosures of which are incorporated herein by reference.

FIELD OF THE DISCLOSURE

The present disclosure is generally related to building construction and more particularly is related to creating exterior seals where building siding meets door and window structures.

BACKGROUND OF THE DISCLOSURE

Fiber cement siding is a hearty, durable, and cost-effective material used to finish exterior walls. Often, fiber cement siding is formed into rigid boards or panels that are affixed to exterior walls similar to wooden clapboards. Where exterior walls contain doors and windows, it is necessary to create an airtight seal between the siding and the jamb. Traditionally, caulking is installed between the siding and the jamb of the window or door.

However, as a building heats and cools, the jamb expands and contracts, straining the seal created by the caulking. Over time, this can cause the caulk seal to break, exposing the building to moisture, temperature, and insects. This exposure can lead to costly damage to the structure of the building.

Similarly, vinyl siding is routinely used as a low-cost, durable exterior siding for buildings, where panels of vinyl siding are attached to the building's wall. The ends of the panels are located within a J-channel which is conventionally abutted against a jamb of a door or window. However, the fluctuation in the J-channel can cause strains in caulking and other seals, thus leading to undesired exposure to the structure of the building.

Thus, a heretofore unaddressed need exists in the industry to address the aforementioned deficiencies and inadequacies.

SUMMARY OF THE DISCLOSURE

Embodiments of the present disclosure provide a system and method for creating an airtight seal between a jamb and a siding panel on an exterior wall. In this regard, one embodiment of such a method, among others, can be broadly summarized by the following steps: providing a stop bead running the length of the jamb, the stop bead comprising an at least partially flexible spacing strip attached to an edge of a rigid base panel; placing the stop bead against the jamb, wherein a first side of the spacing strip is in contact with the jamb and the base panel lies flat against the exterior wall; securing the base panel to the exterior wall; and installing the siding panel to the exterior wall, wherein the base panel is between the exterior wall and the siding panel.

The present disclosure can also be viewed as providing an apparatus for creating an airtight seal between a jamb and a siding panel on an exterior wall. Briefly described in architecture, one embodiment of the apparatus, among others, can be implemented as follows. An apparatus for creating an airtight seal between a jamb and a siding panel on an exterior wall includes a stop bead running the length of the jamb. The stop bead includes an at least partially flexible spacing strip attached to an edge of a rigid base panel.

The present disclosure can also be viewed as providing an apparatus for creating an airtight seal between a jamb and a siding panel on an exterior wall. Briefly described in architecture, one embodiment of the apparatus, among others, can be implemented as follows. An apparatus for creating an airtight seal between a jamb and a siding panel on an exterior wall includes a stop bead running the length of the jamb. The stop bead includes an at least partially flexible spacing strip attached to an edge of a rigid base panel. A side of the base panel attached to the spacing strip is sized to be in contact with a portion of a J-channel having ends of the siding positioned therein.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
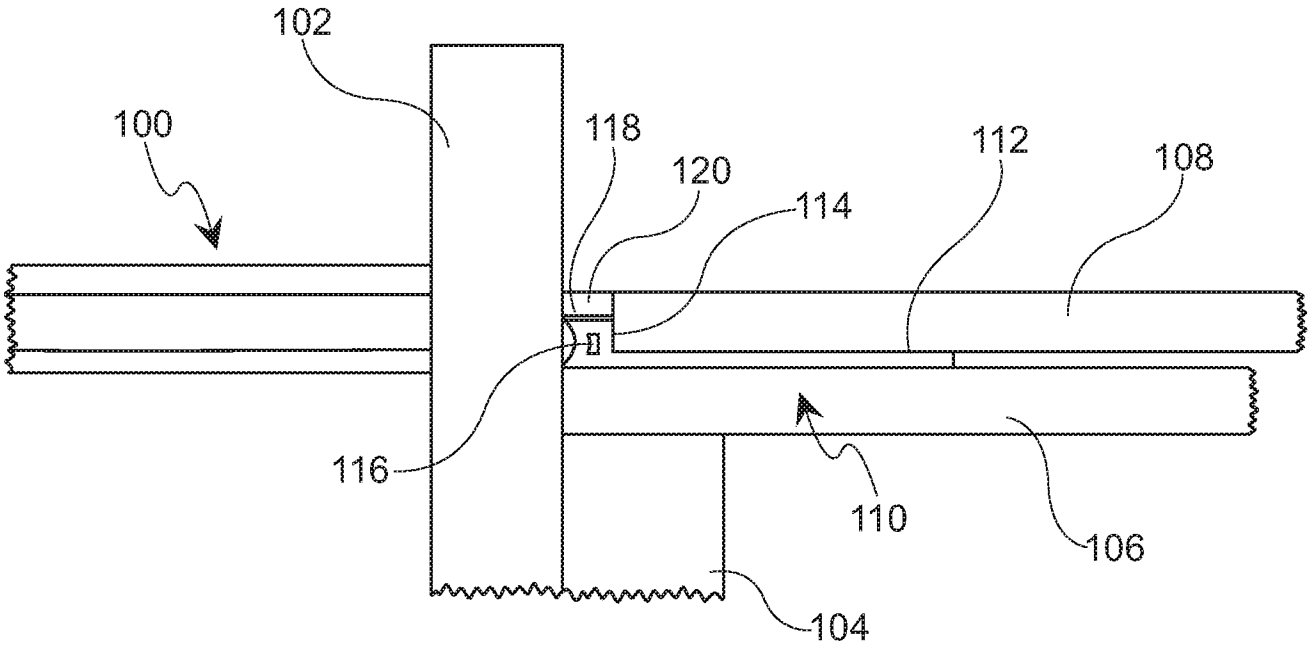
FIG. 1 is an overhead cross-sectional illustration of an exterior wall with a stop bead installed, in accordance with a first exemplary embodiment of the present disclosure.

FIG. 1 is a cross-sectional illustration of an exterior wall with a stop bead 110 installed, in accordance with a first exemplary embodiment of the present disclosure. The structure of the wall is formed by a backing 106, which is affixed to framing 104.A window jamb 102 is nailed to the framing 104, and a window 100 installed within the framework of the jamb 102. A stop bead 110 having a spacing strip 114 and a base panel 112 is placed against the jamb 102. A first side of the spacing strip 114 is in contact with the jamb 102, and the base panel 112 lies flat against the backing 106 of the exterior wall. The base panel 112 is secured to the backing 106. A siding panel 108 is installed to the backing 106 of the wall; the base panel 112 is between the backing 106 and the siding panel 108. Caulking 120 is installed in the exterior space created between the jamb 102, the spacing strip 114, and the siding panel 108. The caulking 120 bonds to the surfaces of the jamb 102, the spacing strip 114, and the siding panel 108 to form an airtight seal.

The exterior wall structure may be any material utilized in building construction. Preferably, the backing 106 and framing 104 are materials prescribed by relevant building codes and trade practices, usually wood or a similar material. In one example, the backing 106 is covered by water-resistant or temperature insulating material to prevent water or adverse temperatures from negatively affecting the interior of the building. The window jamb 102 may alternatively be a door jamb or horizontal or vertical framing for any other type of opening in the wall. In one example, the jamb may be any framing that separates exterior finishes, for instance, in a corner where two exterior walls meet. The window or door may be installed within the jamb before the stop bead is installed, or the stop bead may be installed first.

The stop bead 110 is comprised of a spacing strip 114 and a base panel 112. In this example, the spacing strip may be an elongated hollow tube with a hollow center and a substantially rectangular cross-section. One side of the spacing strip 114 may be concave toward the center of the spacing strip 114, the shape of which allows the edges of the side to be biased against and maintain contact with the jamb while also remaining flexible if the jamb should expand or contract. The hollow center 116 of the spacing strip provides additional flexibility. In this example, the shape of the hollow center 116 may be substantially rectangular with one concave side concentric with the concave side of the spacing strip. However, other shapes may provide more or less flexibility as needed. For instance, in one example the spacing strip 114 may include a non-hollow center. Additionally, the thickness of the spacing strip may vary depending upon the application. The spacing strip is preferably made of a flexible and resilient material, for example exterior grade vinyl, metal, plastic, polymer, compressible foams, composite materials, or any combination thereof.

The spacing strip 114 is located on the edge of a base panel 112. The base panel 112 lies flat against the backing 106. The base panel 112 is generally rectangular, with perforated holes extending therethrough. This is discussed in greater detail in FIG. 2A. In one example, the sides of the spacing strip 114 may measure about ¼" by ¼". The base panel 112 may be thin, such as less than ½ inch, in one example. It may be made of a rigid material such as a rigid plastic, vinyl, metal, polymer, or a composite material. In this example, the base panel 112 may be about 2 inches in width. In other examples it may be shorter or longer.

The stop bead 110 may be manufactured as separate pieces—the base panel 112 and spacing strip 114—secured together. In another example, the stop bead 110 may be of unitary construction. In such an example, the thickness and sizing of the base panel 112 and spacing strip 114 are adjusted to allow the base panel to be rigid while the spacing strip remains flexible and resilient.

When installed, the stop bead 110 is in contact with the jamb 102, the backing 106, and the siding 108. In this example, the side of the spacing strip 114 facing the framing 104 may not come into contact with any portion of the exterior wall or other framework; there is an air gap. However, in some examples, the spacing strip 114 may be in contact with the backing 106 or other framework. In one example, the spacing strip 114 may extend back toward the framing 104 to wholly or partially fill the space between the backing 106, the jamb 102, and the framing 104.

In one example of the present disclosure, the stop bead 110 includes a bond-breaking tape 118 along the exterior surface of the spacing strip 114 that lies between the jamb and the siding panels. The bond-breaking tape 118 may allow for the formation of a bond between the caulk 120 and the bond-breaking tape 118 but allow for the caulk 120 to be removed, as needed for repairs or other situations, by separation of the bond-breaking tape 118 and the spacing strip 114.

After the stop bead 110 has been installed, one or more siding panels 108 are installed over the base panel 112 and attached to the backing 106. This is discussed in greater detail in FIG. 3.

The caulking 120 is installed in the exterior space created between the jamb 102, the spacing strip 114, and the siding panel 108. The caulking may be any exterior-grade caulking used for creating seals on exterior walls. Preferably, it is one prescribed by appropriate building codes or common trade practices.

Figure 2A:
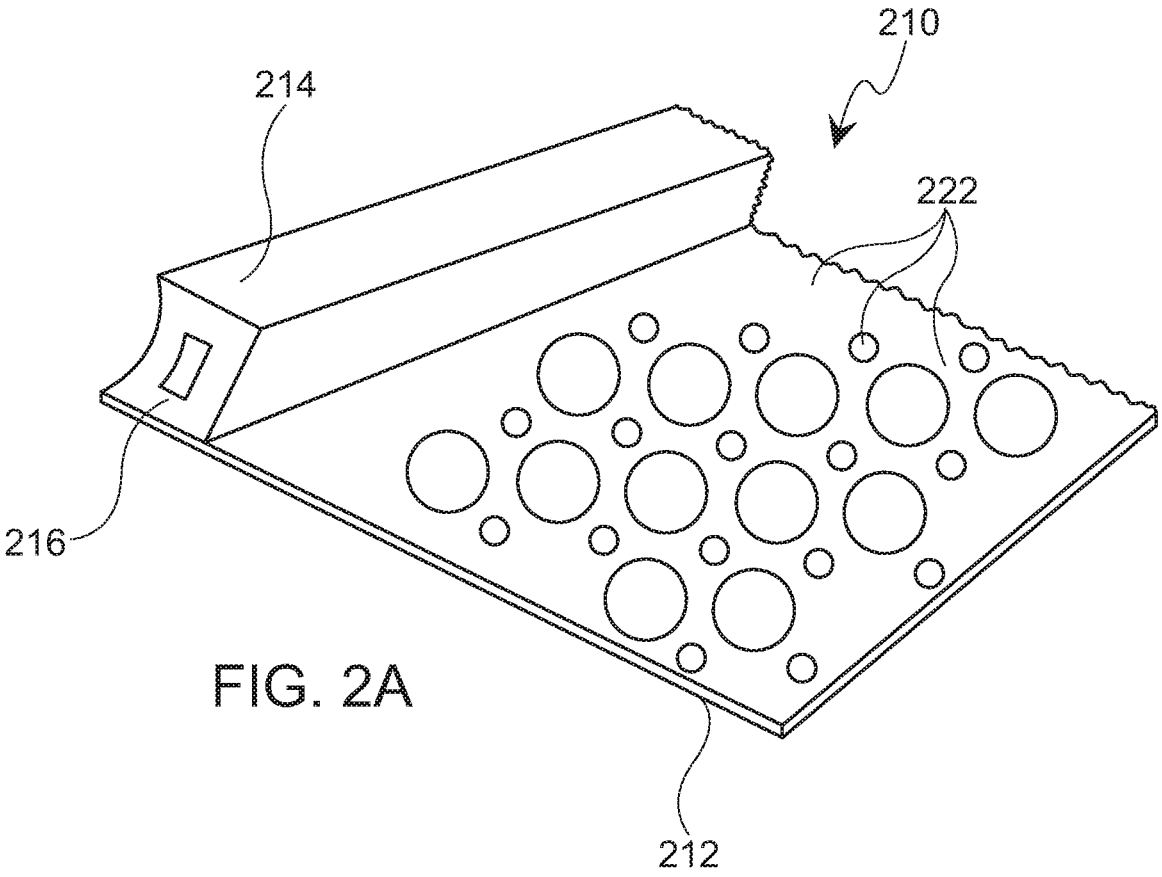
FIGS. 2A-B are elevation and cross-sectional illustrations of the stop bead.
Figure 2B:
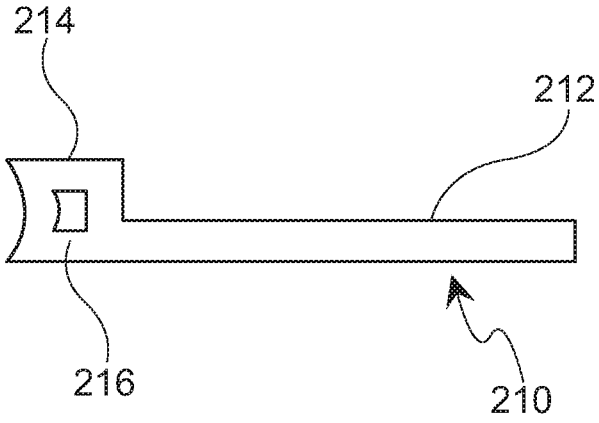

FIGS. 2A and 2B are elevation and cross-sectional illustrations of the stop bead 210. In FIG. 2A, the stop bead 210 is shown comprising a flat length of base panel 212 and a spacing strip 214 atop the base panel 212. The spacing strip 214 is shown as substantially rectangular hollow tube with one concave side and a hollow center 216. The base panel 212 has a series of perforated holes 222 for mounting to an exterior wall. Preferably, the holes are located at periodic intervals and in sizes appropriate for mounting hardware. In another example, the holes may be randomly spaced and sized. In this example, the perforated holes 222 are sized for framing nails to fit snugly, securing the base panel 212 to the backing of the exterior wall. Preferably, nails are used to secure the base panel 212 to the backing. However, any appropriate hardware or method may be used, such as screws, bolts, epoxies, or other bonding methods.

The stop bead 210 may be manufactured in any suitable length, preferably in lengths of several feet or more. During installation, the stop bead 210 may be cut to fit the appropriate length of the jamb. Multiple lengths of stop bead 210 may be used, one after another, along the length of the jamb. In one example, the stop bead 210 may be cut to bend around the framing along a door or window, so that one continuous piece is in contact with multiple sides of the framing.

FIG. 2B shows a side view of the stop bead 210, having base panel 212, spacing strip 214, and hollow center 216.

Figure 3:
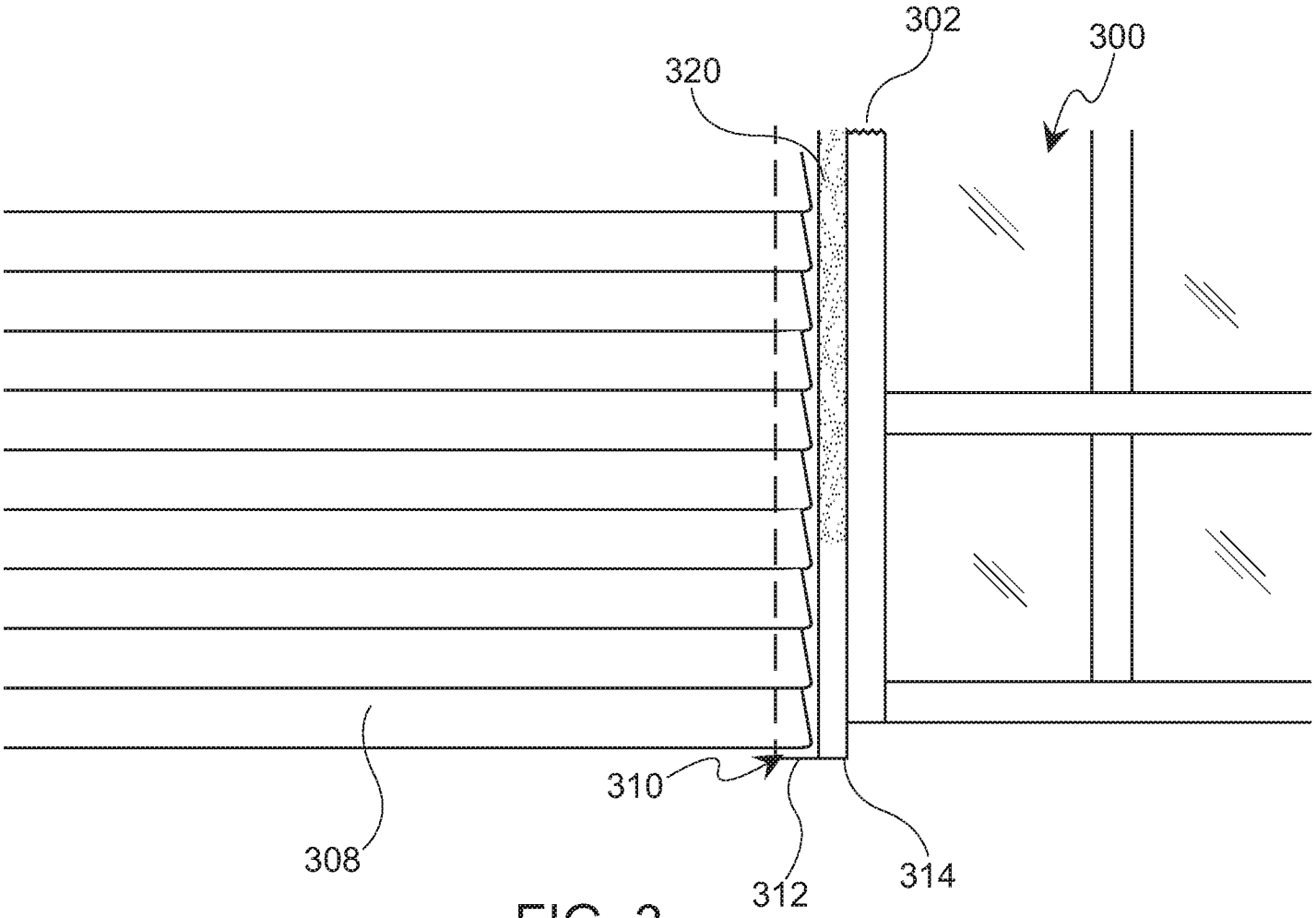
FIG. 3 is an elevation illustration of the stop bead installed adjacent to siding panels.

FIG. 3 is an elevation view of the stop bead 310 installed in a wall with siding panels 308. The stop bead 310 is installed so that the spacing strip 314 is in contact with the jamb 302 of a window 300. The base panel 312, indicated by the dotted line is installed flat against the wall, then the siding panels 308 are installed over the base panel 312. In this example, the siding panels 308 are shaped to resemble wooden clapboards. In other examples, the siding panels 308 may be shaped and sized to resemble a variety of exterior siding finishes. The siding panels 308 are installed in an overlapping manner. The lowest panels are installed in contact with the base panel 312 and a side of the spacing strip 314. Subsequent panels are installed just above the previous panels so that the panels overlap to some degree. Each panel is placed snugly against the stop bead 310. Once installed, the exterior side of the spacing strip 314 spans the distance between the edge of the siding panels 308 and the window jamb 302. Caulking 320 is added on top of the spacing strip 314 and creates an airtight seal between the siding panels 308 and the jamb 302. In examples with bond-breaking tape (not shown), a double-sided joint is created. In examples without bond-breaking tape, a triple sided joint is created with the spacing strip 314.

It should be noted that the invention discussed herein may be used with a variety of wall siding materials, including vinyl siding, fiber cement siding, brick siding, and the like. Where certain materials are specifically mentioned, they may be used interchangeably with any other materials without deviating from the scope and purpose of the invention. The size of the spacing strip 314 may vary depending on the specific application of the stop bead 310 and/or the dimension of a window or door jamb with which the stop bead 310 is used. In one example, the spacing strip 314 may be approximately 0.25 inches by 0.25 inches. In other examples, the spacing strip 314 may be 0.375 inch by 0.375 inch, 0.5 inch by 0.5 inch, or any other dimension.

Figure 4:
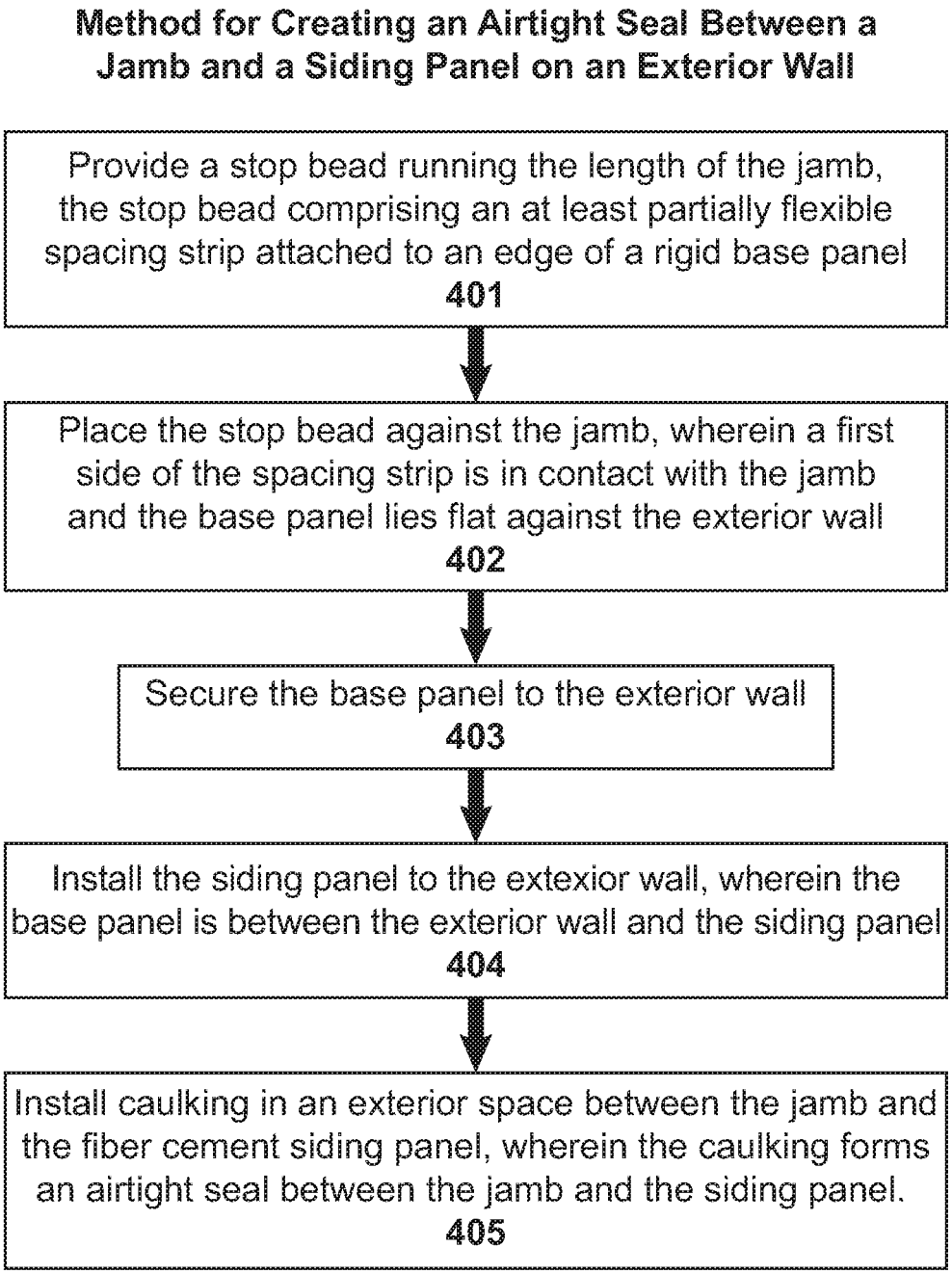
FIG. 4 is a flow chart illustrating a method of creating an airtight seal between a jamb and a siding panel on an exterior wall, in accordance with the first exemplary embodiment of the present disclosure.

FIG. 4 is a flow chart illustrating a method for creating an airtight seal between a jamb and a siding panel on an exterior wall, in accordance with the first exemplary embodiment of the disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 401, a stop bead running the length of the jamb is provided, the stop bead comprising an at least partially flexible spacing strip attached to an edge of a rigid base panel.

As is shown by block 402, the stop bead is placed against the jamb, wherein a first side of the spacing strip is in contact with the jamb and the base panel lies flat against the exterior wall.

As is shown by block 403, the base panel is secured to the exterior wall.

As is shown by block 404, the siding panel is installed on the exterior wall, wherein the base panel is between the exterior wall and the siding panel.

As is shown by block 405, caulking is installed in an exterior space between the jamb and the siding panel, wherein the caulking forms an airtight seal between the jamb and the siding panel.

The method may further include any other features, components, or functions disclosed relative to any other figure of this disclosure.

Figure 5A:
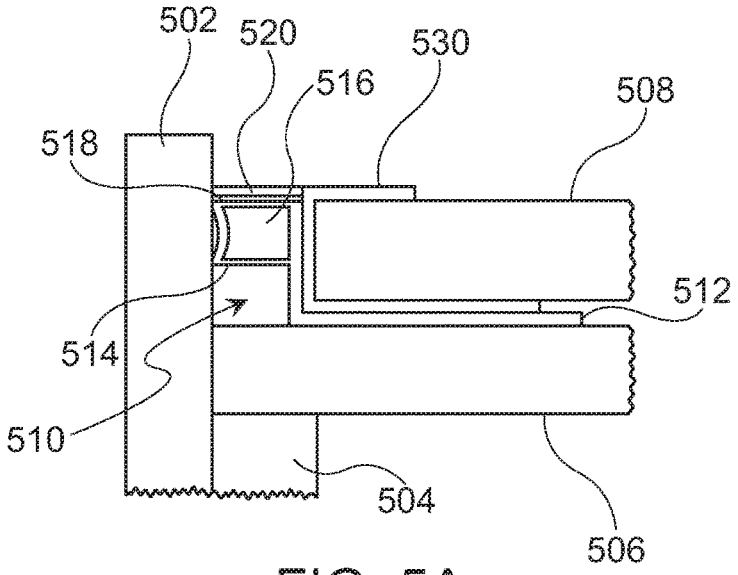
FIGS. 5A-B are overhead cross-sectional illustrations of an exterior wall with a stop bead installed, in accordance with a second exemplary embodiment of the present disclosure.
Figure 5B:
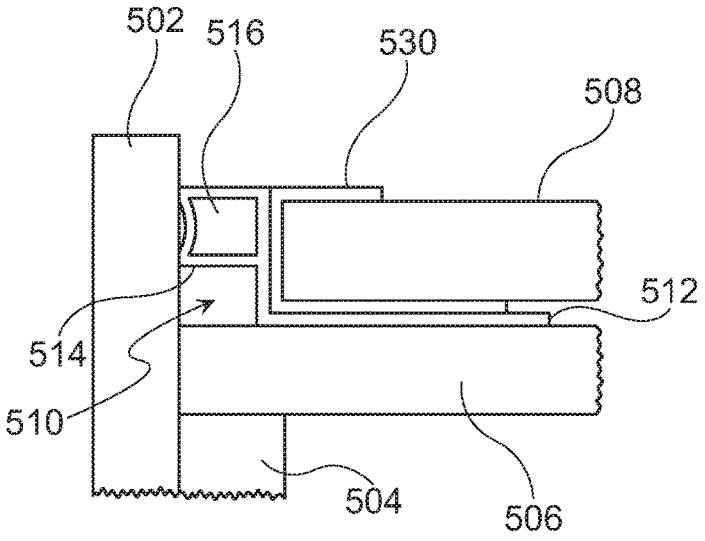

FIGS. 5A-B are overhead cross-sectional illustrations of an exterior wall with a stop bead installed, in accordance with a second exemplary embodiment of the present disclosure.

The structure of the wall is formed by a backing 506, which is affixed to framing 504. A stop bead 510 having a spacing strip 514 and a base panel 512 is placed against the jamb 502. A first side of the spacing strip 514 is in contact with the jamb 502, and the base panel 512 lies flat against the backing 506 of the exterior wall. The base panel 512 is secured to the backing 506. A separate J-channel 530 may be installed against the stop bead 510 in contact with the spacing strip 514 and the base panel 512. The J-channel 530 forms a flashing for the ends of vinyl siding 508. A vinyl siding panel 508 is installed against the interior of the J-channel 530. The J-channel 530 may be nailed against the stop bead 510 after the stop bead 510 has been nailed to the backing.

In FIG. 5A, caulking 520 is installed in the exterior space created between the jamb 502, the spacing strip 514, and the vinyl siding panel 508. The caulking 520 bonds to the surfaces of the jamb 502, the spacing strip 514, and the J-channel 530 to form an airtight seal. In one example, the stop bead 510 includes a bond-breaking tape 518 along the exterior surface of the spacing strip 514 that lies between the jamb 502 and the J-channel 530. The bond-breaking tape 518 may allow for the formation of a bond between the caulk 520 and the bond-breaking tape 518 but allow for the caulk 520 to be removed, as needed for repairs or other situations, by separation of the bond-breaking tape 518 and the spacing strip 514. In FIG. 5B, the stop bead 510 is shown flush with the J-channel 530.

The stop bead 510 is comprised of a spacing strip 514 and a base panel 512. In this example, the spacing strip may be an elongated hollow tube with a substantially rectangular cross-section. One side of the spacing strip 514 may be concave toward the center of the spacing strip 514, the shape of which allows the edges of the side to be biased against and maintain contact with the jamb 502 while also remaining flexible if the jamb 502 should expand or contract. The hollow center 516 of the spacing strip provides additional flexibility. In this example, the shape of the hollow center 516 may be substantially rectangular with one concave side concentric with the concave side of the spacing strip 514. However, other shapes may provide more or less flexibility as needed. Additionally, the thickness of the spacing strip 514 may vary depending upon the application. The spacing strip 514 is preferably made of a flexible and resilient material, for example exterior grade vinyl, metal, plastic, polymer, compressible foams, composite materials, or any combination thereof.

The base panel 512 may be a flat, rigid, L-shaped panel having a short side and a long side, wherein the spacing strip 514 is attached to an exterior face of the short side. The base panel 512 lies flat against the backing 506 and flat with the spacing strip 514. The portion of the base panel 512 that lies against the spacing strip 514 may be long enough to contact a portion of the J-channel 530. As shown in FIG. 5A, the base panel 512 is long enough to contact a substantial portion of the J-channel 530, for example, no longer than ¾ inch. This allows the J-channel 530 to be placed even or flush against the stop bead 510, while allowing room for caulking 520 and bond-breaking tape 518. As shown in FIB. 5B, the base panel 512 is long enough to be substantially even or flush with the J-channel 530.

The base panel 512 may be made of a rigid material such as a rigid plastic, vinyl, metal, polymer, or a composite material. In this example, the side of the base panel 512 in contact with the backing 506 may be about 1¾ inches in width. In other examples it may be shorter or longer. The sides of the base panel 512 are generally rectangular, with perforated holes extending through the side in contact with the backing 506 to allow it to be fastened to the backing.

The stop bead 510 may be manufactured as separate pieces—the base panel 512 and spacing strip 514—secured together. In another example, the stop bead 510 may be of unitary construction. In such an example, the thickness and sizing of the base panel 512 and spacing strip 514 are adjusted to allow the base panel to be rigid while the spacing strip remains flexible and resilient.

Figure 6:
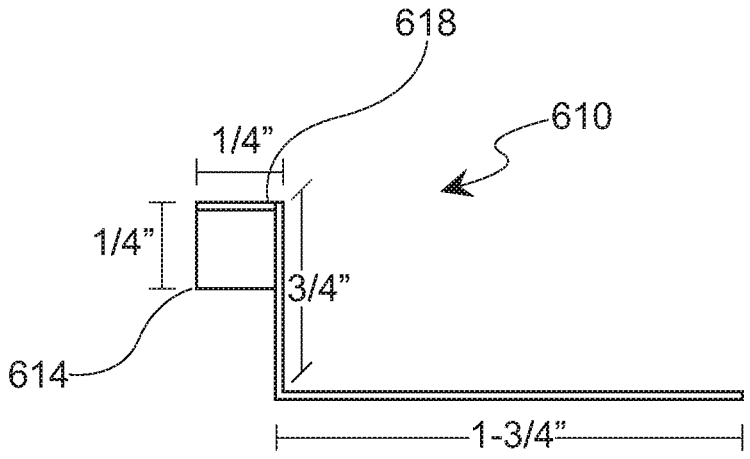
FIG. 6 is a cross-sectional illustration of the stop bead shown in FIGS. 5A-B, in accordance with the second exemplary embodiment of the present disclosure.

FIG. 6 is a cross-sectional illustration of the stop bead shown in FIGS. 5A-B, in accordance with the second exemplary embodiment of the present disclosure. The stop bead 610 comprises a flexible spacing strip 614 and a rigid base panel 612. The base panel 612 is shown as an L-shape attached to the spacing strip 614, with the smaller side of the base panel 612 about ¾ inches in length when measured from the inside of the "L", and the longer side of the base panel 612 about 1¾ inches in length when measured from the outside of the "L." In one embodiment, the base panel 612 may not be L-shaped, but may simply be flat. In this embodiment, the spacing strip 614 may be positioned atop the base panel 612 and may be taller or wider to contact a substantial portion of a separate J-channel.

Figure 7A:
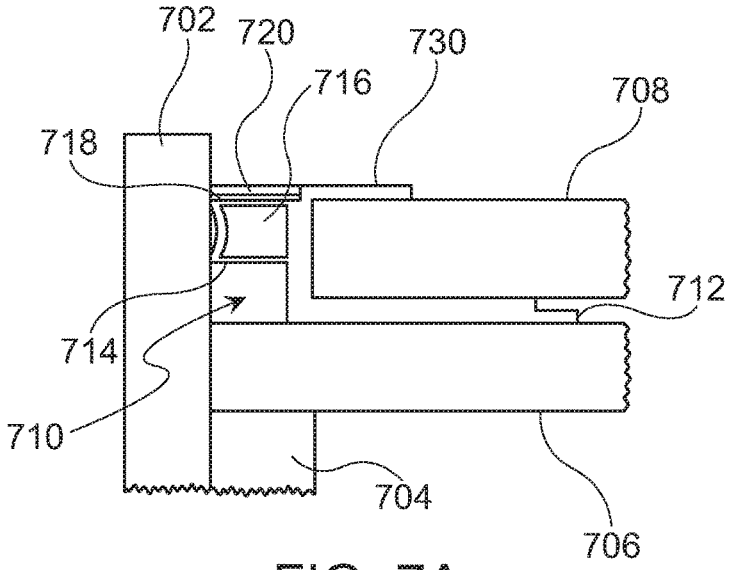
FIGS. 7A-B are overhead cross-sectional illustrations of an exterior wall with a stop bead installed, in accordance with a third exemplary embodiment of the present disclosure.
Figure 7B:
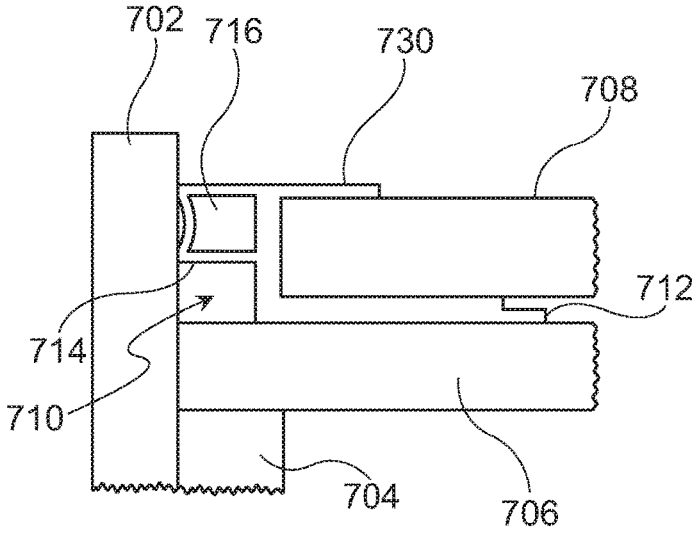

FIGS. 7A-B are overhead cross-sectional illustrations of an exterior wall with a stop bead installed, in accordance with a third exemplary embodiment of the present disclosure.

The structure of the wall is formed by a backing 706, which is affixed to framing 704. A stop bead 710 having a spacing strip 714 and a base panel 712 is placed against the jamb 702. A first side of the spacing strip 714 is in contact with the jamb 702, and the base panel 712 lies flat against the backing 706 of the exterior wall. The base panel 712 is secured to the backing 706. The base panel 712 is shaped as a J-channel 730 having two parallel sides and a perpendicular connecting side therebetween. The spacing strip 714 is formed on an exterior face of the perpendicular connecting side. The J-channel 730 is formed together with the spacing strip 714 and the base panel 712 as part of the stop bead 710. The J-channel portion 730 of the stop bead 710 forms a flashing for the ends of siding 708, and in particular, for vinyl siding. For example, a vinyl siding panel 708 is installed against the interior of the J-channel portion 730 of the stop bead 710, such that the interior of the J-channel portion 730 receives the terminating end of the vinyl siding panel 708. The J-channel portion 730 has two parallel sides and a perpendicular connecting side therebetween. The spacing strip 714 is formed on the perpendicular side of the J-channel portion 730.

In FIG. 7A, caulking 720 is installed in the exterior space created between the jamb 702, the spacing strip 714, and the top of the J-channel portion 730 of the stop bead 710. In one example, the stop bead 710 includes a bond-breaking tape 718 along the exterior surface of the spacing strip 714 that lies between the jamb 702 and the J-channel portion 730. In FIG. 7B, the top of the spacing strip 714 is shown flush with the J-channel portion 730 of the stop bead 710. This design may eliminate the need for caulking 720 to cover the spacing strip 714, and in particular, hide the unsightly appearance of the spacing strip 714 on the wall. Instead, the outer facing edge of the spacing strip 714 and the outer facing edge of the J-channel portion 730 may be provided with a color and/or texture to substantially match that of the siding panel 708, such that an aesthetic and visually appealing joint between the jamb 702 and the wall can be created without caulking or needing to match colors of caulking to the jamb 702 or the wall.

The stop bead 710 and its component portions 712, 714, 730 may otherwise be substantially similar to the stop bead 510 and its component portions as discussed relative to FIGS. 5A-B, including in size, shape, material, flexibility, and construction. Spacing strip 714 may have a hollow center 716 similar to hollow center 516, and may be made of a flexible and resilient material. The base panel 712 may be flat, rigid, and L-shaped similar to 512, and may be made of a rigid material. The stop bead 710 is shown in FIGS. 7A-7B as being of unitary construction.

Figure 8A:
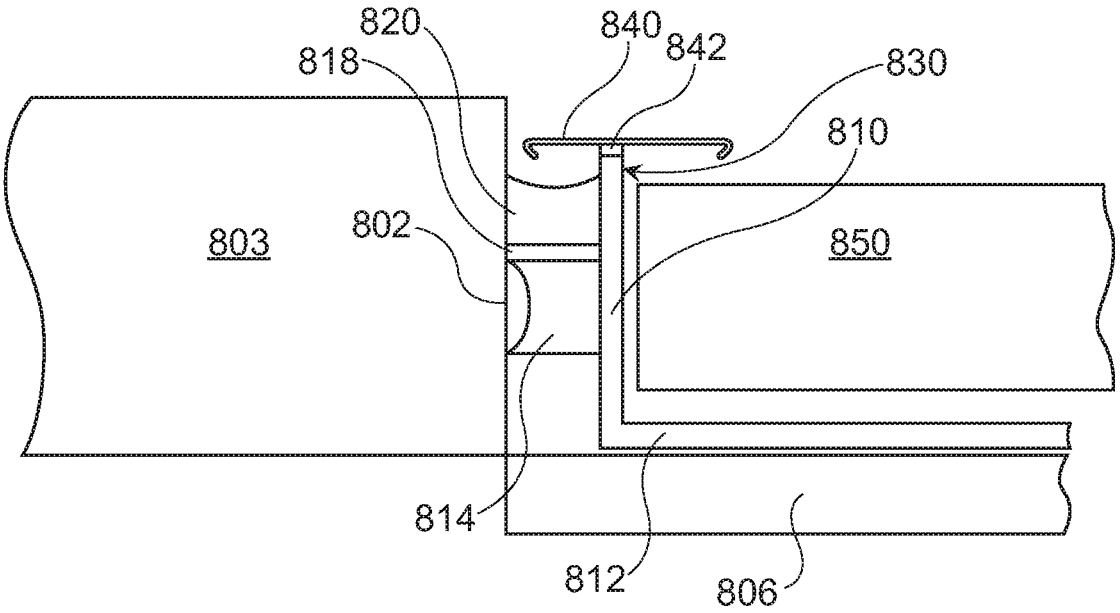
FIG. 8A is an overhead cross-sectional illustration of an exterior wall with a stop bead apparatus, in accordance with a fourth exemplary embodiment of the present disclosure.
Figure 8B:
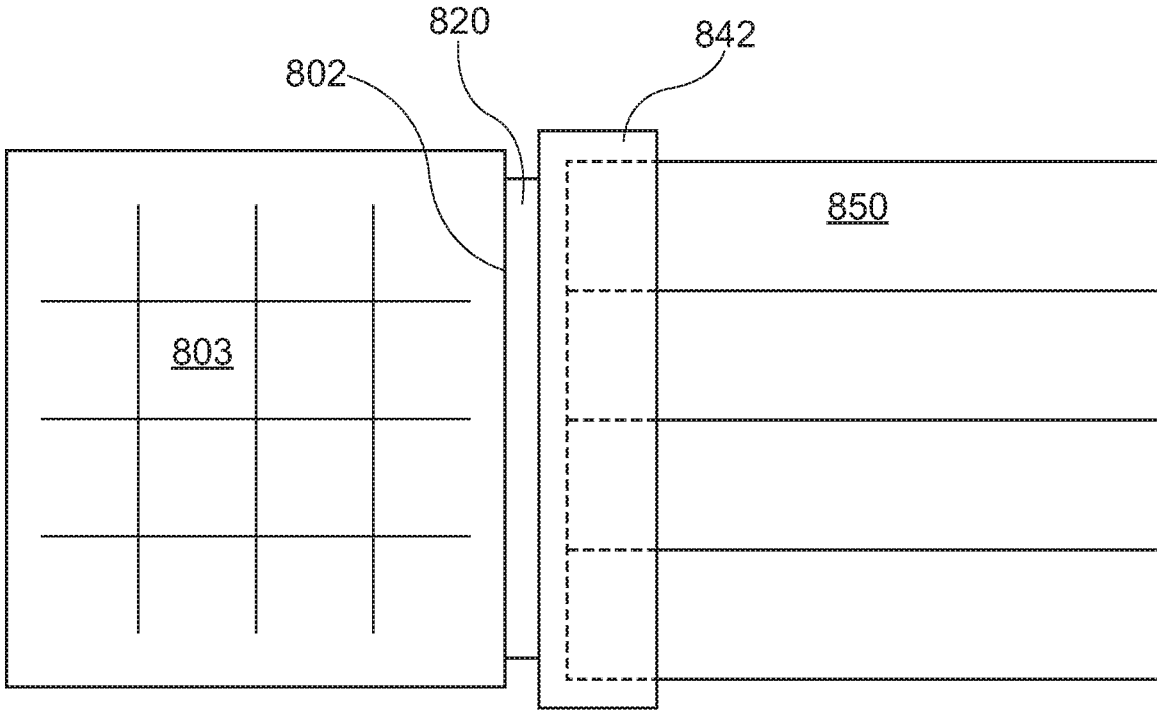
FIG. 8B is a front view illustration of an exterior wall with a stop bead apparatus of FIG. 8A, in accordance with the fourth exemplary embodiment of the present disclosure.
Figure 8C:
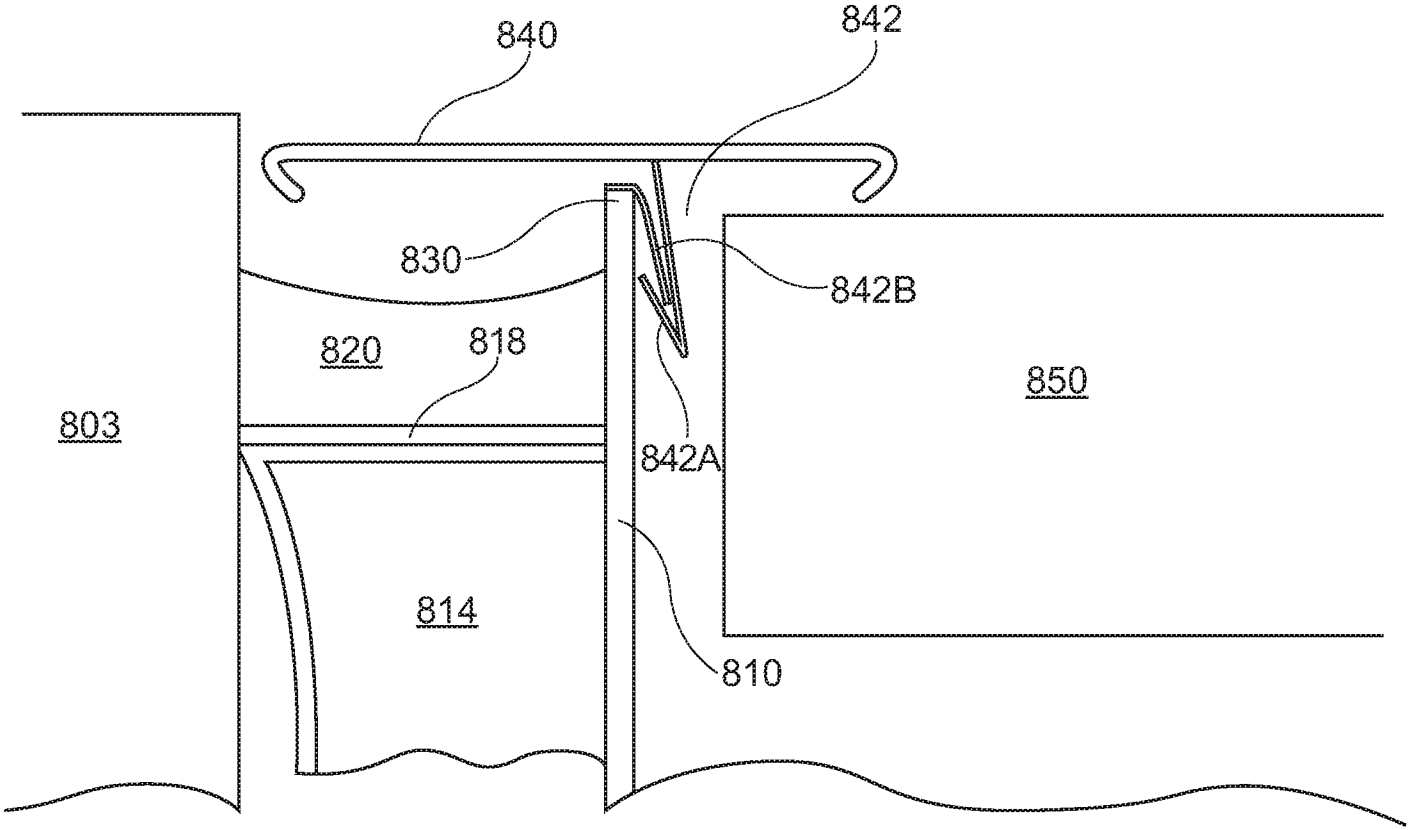
FIG. 8C is a detailed view illustration of a fastening system for use with a stop bead apparatus of FIG. 8A, in accordance with the fourth exemplary embodiment of the present disclosure.

FIG. 8A is an overhead cross-sectional illustration of an exterior wall with a stop bead apparatus, in accordance with a fourth exemplary embodiment of the present disclosure. FIG. 8B is a front view illustration of an exterior wall with a stop bead apparatus of FIG. 8A, in accordance with the fourth exemplary embodiment of the present disclosure. FIG. 8C is a detailed view illustration of a fastening system for use with a stop bead apparatus of FIG. 8A, in accordance with the fourth exemplary embodiment of the present disclosure. As is shown in FIGS. 8A-8C, the structure of the wall is formed by a backing 806, which is affixed to framing. A stop bead 810 having a spacing strip 814 and a base panel 812 is placed against the jamb 802 of a window 803 or similar structure. A first side of the spacing strip 814 is in contact with the jamb 802, and the base panel 812 lies flat against the backing 806 of the exterior wall. The base panel 812 is secured to the backing with fasteners, such as screws or nails. The spacing strip 814 is in a position abutting the jamb 802 with a bond breaking tape 818 and a caulking layer 820 positioned exterior thereof, e.g., exterior on the wall.

At or near a terminating end 830 of the stop bead 810 is a trim member 840 which is removably connected or fastened to the stop bead 810. The trim member 840 may connect to the end or near the end of the stop bead 810 by any type of fastening system 842, such as a fractioning fit or snap-connect system, where structures on the trim member 840 engage with structures on the stop bead 810, or vice versa. FIG. 8C illustrates one type of fastening system 842 which uses a hook 842A positioned extending from the trim member 840 which engages with a prong 842B extending from the stop bead 810. When the trim member 840 is positioned over the stop bead 810, it may be pushed far enough inwards for the hook 842A to engage with the prong 842B, such that the trim member 840 is retained in place (FIG. 8C illustrates the connection slightly exploded, but in practice the hook 842A and the prong 842B may be in biased contact with one another). In one of many alternatives, the trim member 840 may connect to the joint between the stop bead 810 and the vinyl siding panel 850. The trim member 840 may generally extend laterally from its point of connection with the stop bead 810 to cover the joint between the terminating ends of the vinyl siding panels 850 and the stop bead 810, such that the joint is covered. This may be similar to the covered joint when a conventional J-channel is used. The trim member 840 may also extend laterally sideways to cover the caulking joint 820, either partially or fully, depending on the design and intended use of the system. The trim member 840 may have various structures, such as a substantially planar structure with curved edges, and it may have various colors and textures, including those matching the vinyl siding panels 850.

Furthermore, the trim member 840 may not only engage with the stop bead 810 along the vertical run of the trim member 840, but it may also connect at a top edge and/or bottom edge of the stop bead 810. For example, during installation, the installer may connect the top edge of the trim member 840 to the top edge of the stop bead 810 and then connect the bottom edge of the trim member 840 to the bottom edge of the stop bead 810, at which point the fasteners 842 positioned along the vertical length of the trim member 840 can engage with the terminating end 830 of the stop member 810. Any connections and/or engagements between the stop bead 810 and the trim member 840 may be used, all of which are considered within the scope of the present disclosure.

When the trim member 840 is used, it may make it easier for color matching on the exterior of the structure. For instance, color matching the stop bead 810 to the color of the vinyl siding panels 850 may be difficult due to different manufacturing techniques and companies. By using the trim member 840 to cover the stop bead 810, and the caulking joint 820, if desired, it allows for an aesthetically enhanced finished wall, versus one where the color of the vinyl siding panels 850 does not fully or completely match the color of the stop bead 810 and/or the caulking joint 820. Additionally, the use of the removable trim member 840 to the stop bead 810 effectively allows for the presence of a J-channel structure for retaining the ends of the vinyl siding panels 850 without the use of a conventional J-channel.

FIGS. 9A-9D are overhead cross-sectional illustrations of a stop bead apparatus 910, in accordance with a fifth exemplary embodiment of the present disclosure. The stop bead 910 includes a base panel 912 which is positioned to be installed against a backing of a wall (not shown), where the backing is affixed to framing of the wall. The stop bead 910 has a spacing member 914 which is positioned to abut a jamb 702 (not shown), whereby a first side of the spacing member 914 may be in contact with the jamb while the base panel 912 lies flat against the backing of the exterior wall. The base panel 912 is secured to the backing with appropriate nails, screws or other fasteners, as are commonly used in the art. The base panel 912 may be a substantially planar structure which is connected to the spacing member 914 with a stop bead wall 916, which may also be known as a spacing member strip, which is connected to the base panel 912 along one edge thereof, and extends in a substantially perpendicular direction from the planar base panel 912, such that the stop bead wall 916 extends outwards from the backing of the wall when the base panel 912 is attached to the wall. The spacing member 914 is connected to an exterior side of the stop bead wall 916 and extends laterally away from the stop bead wall 916, such that the spacing member 914 is positioned on an opposing side of the stop bead wall 916 from the direction the base panel 912 extends towards.

Figure 9B:
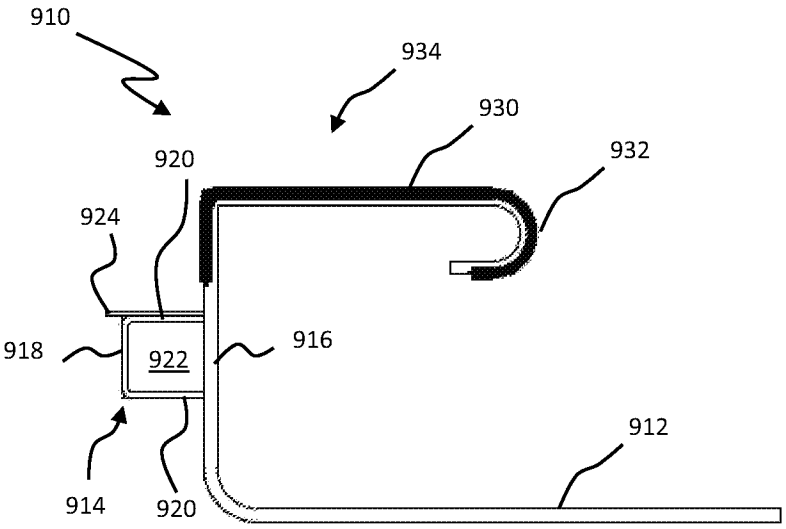
FIGS. 9A-9D are overhead cross-sectional illustrations of a stop bead apparatus, in accordance with a fifth exemplary embodiment of the present disclosure.
Figure 9A:
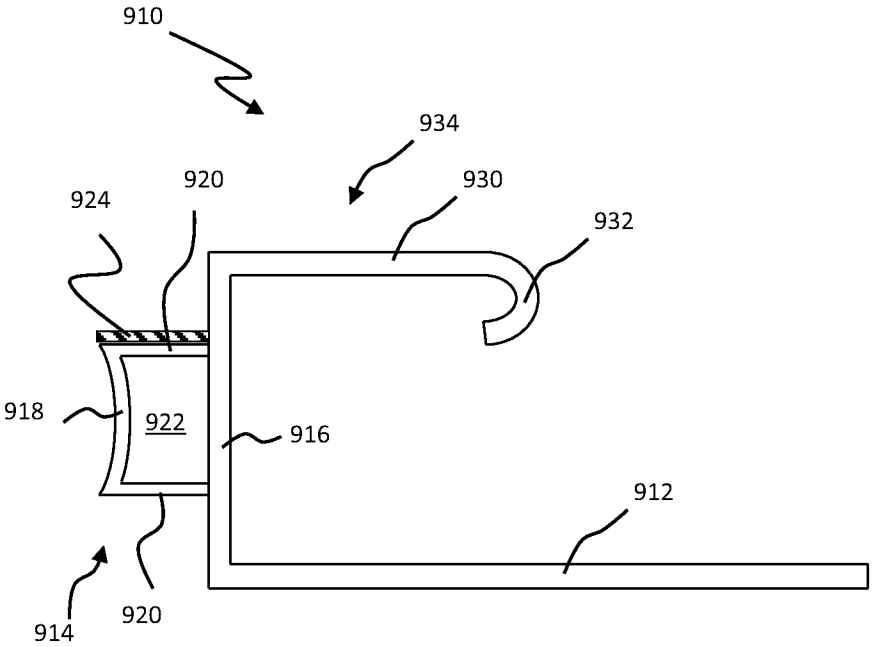

It is noted that the spacing member 914 may include two or more extending legs 920 which contact a curved or arched engaging face 918, as shown in FIG. 9A, whereby the engaging face 918 is positioned to abut the jamb when the apparatus 910 is installed. In this design, a hollow interior 922 may be formed between the extending legs 920 and the engaging face 918. Other designs for the spacing member 914 may also be used, including those with other structures, such as foam spacing members which are formed from an open or closed cellular foam structure. As shown in FIG. 9B, the engaging face of the spacing member 914, in some situations, may not have a curved face, but may have a substantially flat face. Additionally, as shown in FIG. 9B, the corners of the spacing member 914 formed between the legs 920 and the engaging face 918 may be rounded or chamfered, which may ensure that molding of the stop bead 910 is achieved with more precision and efficiency.

Additionally, the junction between the base panel 912 and the stop bead wall 916 may be curved with a radius, as shown in FIG. 9B, which may aid in molding the apparatus 910 more efficiently than a conventional right-angled connection. Additionally, the curvilinear shape of the junction between the base panel 912 and the stop bead wall 916 may allow for the apparatus 910 to be positioned closer to the jamb (not shown) than a device with right-angle joint if there is an obstruction positioned along the backing of the exterior wall near the jamb. A bond breaking structure 924, such as a bond-breaking tape, strip, or other bond-breaking material, such as a foam backing rod, may be included on the exteriorly-exposed surface of the spacing member 912.

As shown in FIGS. 9A-9D, the base panel 912 also has a front wall 930 which has a J-channel portion 932 formed therein. The J-channel portion 932 may be positioned at a location approximately half the length of the base panel 912, but other positions and orientations are also possible. For example, in this position, the J-channel portion 932 together with the front wall 930 may extend in a direction substantially parallel to the base panel 912 for a distance that substantially matches or exceeds a length of the stop bead wall 916. In accordance with this disclosure, substantially matching or exceeding a length of the stop bead wall 916 may be understood to be a length which is slightly less (e.g., a fraction of an inch), equivalent, or greater than the length of the stop bead wall 916, as measured between the joint of the stop bead wall 916 with the base panel 912 and the front wall 930, respectively. The J-channel portion 932 includes a turned-back portion positioned at an end of the front wall 930. The turned-back portion, as shown in FIGS. 9A-9D, may have a substantially continuous, substantially curvilinear shape, such that the surface of the front wall 930 substantially extends in a continuous or semi-continuous manner along the turned-back portion until it is facing towards the base panel 912 or further, such as towards the stop bead wall 916, as shown.

As shown in FIG. 9B, the J-channel portion 932 may have a capstock area 934 positioned over it and over at least a portion of the front wall 930. The capstock area 934, which may be understood as a weatherable capstock, may be provided on the front wall 930 and the J-channel portion 932 to increase its durability and weatherization against the elements, in that, the thickness of the capstock area 934 may be provided to be 0.01 of an inch (or some similar amount, such as 0.01 inch to 0.09 inch, or greater or less) thicker than all or a portion of the rest of the portions of the stop bead 910, e.g., such as the base panel 912 and the stop bead wall 916. Accordingly, as shown in FIG. 9B, the front wall 930, the J-channel portion 932, and an exterior part of the stop bead wall 916 may have the capstock area 934 (illustrated in black, not to exact dimension), as these portions of the stop bead 910 may be exposed to the elements and weather during use. The thicker construction of these portions may allow for increased durability of the stop bead 910, thereby providing a better product with a longer lifespan. It is further noted that the capstock area 934 may include other features, such as coloring, texturing or patterns imprinted or molded thereon to increase aesthetics of the stop bead 910. These may include faux wood grains, or texturing, such as those matching brick or concrete or other construction materials, or they may include a specific color which is selected to match the siding.

Figure 9C:
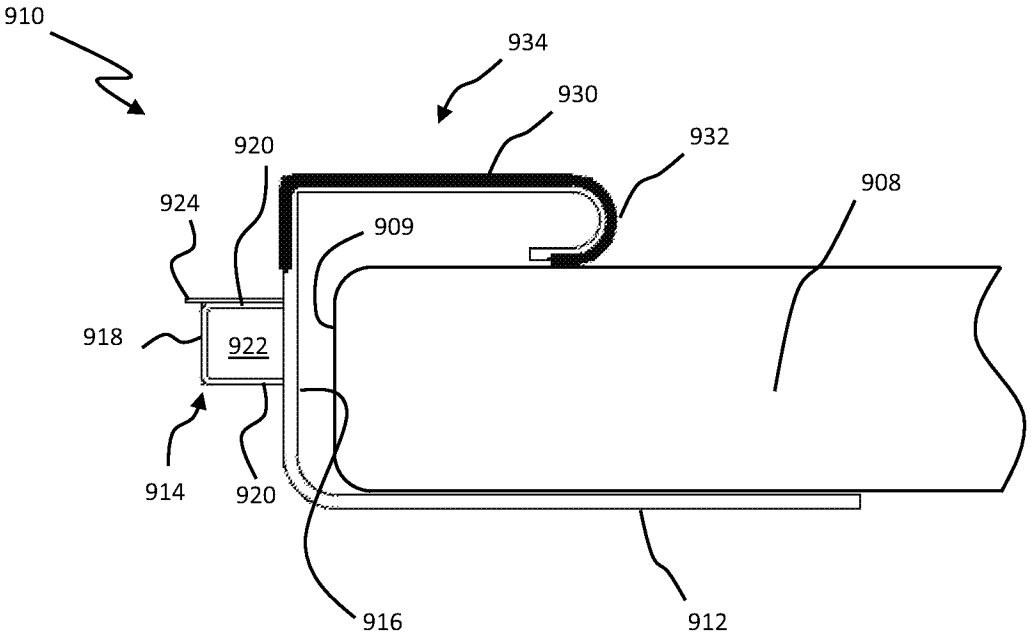

FIG. 9C illustrates the stop bead 910 in use with siding panel 908, where the terminating edges 909 of the siding panel 908 are positioned interior of the front wall 930 of the J-channel portion 932, e.g., in a location between the base panel 912 and the front wall 930. In this position, an exterior surface of the siding panel 908 (i.e., facing outwards) may make contact with an interior-most portion of the turned-back portion of the J-channel portion 932. Due to the dimension and shape of the J-channel portion 932, when the siding panel 908 is in this position, an interior surface of the front wall of the J-channel portion (i.e., facing the base panel 912) may be free from contact with the siding panel 908.

Figure 9D:
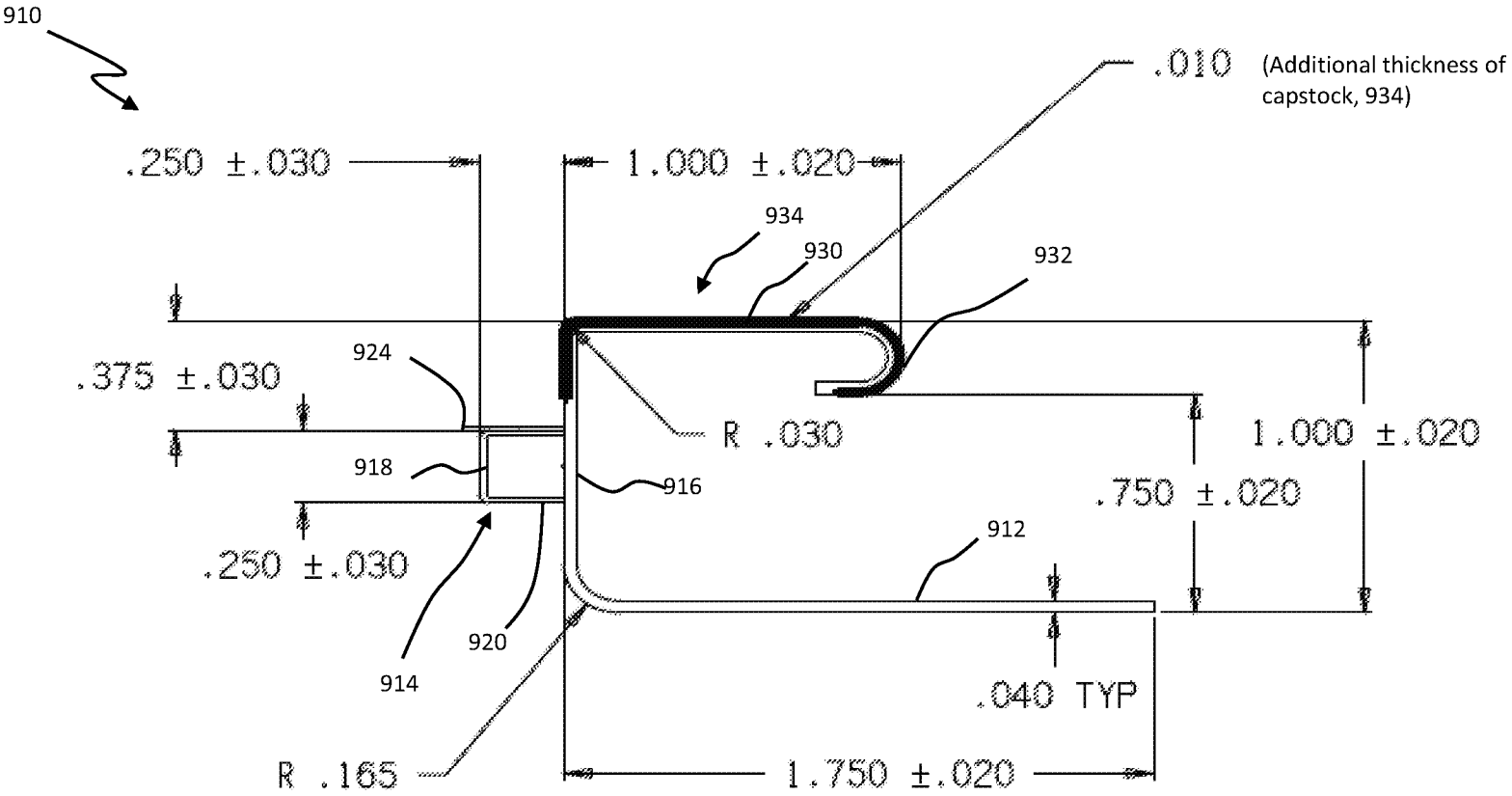

While the dimensions of the stop bead 910 may vary, in one example as illustrated in FIG. 9D, the base panel 912 is approximately 1.75" in length, the stop bead wall 916 is approximately 1.00" in length, the front wall 930 is approximately 1.00" in length, the J-channel 932 is approximately 0.25" deep, and the thickness of the stop bead 910 is approximately 0.040". These dimensions are provided as an example of one instance of the stop bead 910, but other instances may have other dimensions, as may be warranted depending on the intended use of the stop bead 910, the climate of use, the manner of installation, or other factors.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A method for creating a seal between a jamb and a siding panel on an exterior wall, comprising the steps of:

providing a stop bead running a length of the jamb, the stop bead comprising:

a base panel;

a stop bead wall connected to the base panel and extending substantially perpendicular from the base panel;

an at least partially flexible spacing strip attached to the stop bead wall;

a J-channel portion connected to the stop bead wall, the J-channel portion having a front wall extending from the stop bead wall in a direction substantially parallel with the base panel, wherein a length of the front wall of the J-channel portion substantially matches or exceeds a length of the stop bead wall, and wherein at least a portion of the J-channel portion has a capstock area;

placing the stop bead against the jamb, wherein a first side of the spacing strip is in contact with the jamb and the base panel lies flat against the exterior wall;

securing the base panel to the exterior wall; and installing the siding panel to the exterior wall, wherein the base panel is between the exterior wall and the siding panel, and wherein terminating edges of the siding panel are positioned interior of the front wall of the J-channel portion.

2. The method of claim 1, further comprising installing caulking in an exterior space between the jamb and the siding panel, wherein the caulking forms an airtight seal between the jamb and the siding panel.

3. The method of claim 2, further comprising placing a bond-breaking tape along an exterior surface of the spacing strip before installation of the caulking.

4. The method of claim 1, wherein the J-channel portion further comprises turned-back portion positioned at an end of the front wall, wherein the turned-back portion has a substantially continuous, substantially curvilinear shape.

5. The method of claim 4, wherein the step of installing the siding panel to the exterior wall further comprises contacting an exterior surface of the siding panel with an interior-most portion of the turned-back portion of the J-channel portion, whereby an interior surface of the front wall of the J-channel portion is free from contact with the siding panel.

6. The apparatus of claim 1, wherein a front surface of the front wall of the J-channel portion is substantially flush with an exterior-most wall of the spacing strip.

7. The method of claim 1, wherein the capstock portion has a thickness of substantially 0.01 inch.

8. An apparatus for creating a seal between a jamb and a siding panel on an exterior wall, the apparatus comprising:

a stop bead running a length of the jamb, the stop bead having:

a base panel positioned to lay flat against the exterior wall;

a stop bead wall connected to the base panel and extending substantially perpendicular from the base panel;

an at least partially flexible spacing strip attached to the stop bead wall, wherein the at least partially flexible spacing strip maintains a seal against the jamb; and a J-channel portion connected to the stop bead wall, the J-channel portion having a front wall extending from the stop bead wall in a direction substantially parallel with the base panel, wherein a length of the front wall of the J-channel portion substantially matches or exceeds a length of the stop bead wall, wherein at least a portion of the J-channel portion has a cap stock area, and wherein terminating edges of the panel are positioned interior of the front wall of the J-channel portion, whereby a seal is created between the siding panel to the jamb through the stop bead.

9. The apparatus of claim 8, wherein a side of the spacing strip facing the jamb is concave toward a center of the spacing strip.

10. The apparatus of claim 8, further comprising a trim member removably connected to an end of the stop bead wall at an exterior end of the stop bead, wherein the trim member extends laterally across the base panel.

11. The apparatus of claim 10, wherein the trim member extends laterally across the spacing strip.

12. The apparatus of claim 8, wherein an outer end of the J-channel is flush with an outer end of the spacing strip.

13. The apparatus of claim 8, wherein a front surface of the front wall of the J-channel portion extends further exterior than an exterior-most wall of the spacing strip.

14. The apparatus of claim 8, wherein the J-channel portion further comprises turned-back portion connected at an end of the front wall, wherein the turned-back portion has a substantially continuous, substantially curvilinear shape.

15. The apparatus of claim 14, wherein an exterior surface of the siding panel is contacted with an interior-most portion of the turned-back portion of the J-channel portion, wherein an interior surface of the front wall of the J-channel portion is free from contact with the siding panel.

16. An apparatus for creating a seal between a jamb and a panel-based siding structure on an exterior wall, the apparatus comprising:

a stop bead running a length of the jamb, the stop bead having:

a base panel positioned to lay flat against the exterior wall;

a stop bead wall connected to the base panel and extending substantially perpendicular from the base panel;

an at least partially flexible spacing strip attached to the stop bead wall and extending from the stop bead wall, thereby creating a spacing distance, wherein the spacing distance is measured from the stop bead wall to a terminating end of the at least partially flexible spacing strip, wherein the terminating end of the at least partially flexible spacing strip is sized to be in contact with the jamb to form a seal against the jamb; and a J-channel portion connected to a terminating end of the stop bead wall, the J-channel portion having a front wall extending from the stop bead wall in a direction substantially parallel with the base panel, wherein a length of the front wall of the J-channel portion matches or exceeds a length of the spacing distance of the at least partially flexible spacing strip, wherein at least a portion of the J-channel portion has a capstock area, and wherein terminating edges of the panel-based siding structure are positionable interior of the front wall of the J-channel portion, whereby a seal is created between the panel-based siding structure to the jamb through the stop bead.

17. The apparatus of claim 16, wherein a terminating end of the stop bead wall is sized to be flush with an exterior-most wall of the spacing strip.

18. The apparatus of claim 16, wherein the panel-based siding structure further comprises at least one of: a fiber-cement siding panel, a vinyl siding panel, or a brick siding structure.

19. The apparatus of claim 18, wherein the J-channel portion further comprises turned-back portion connected at an end of the front wall, wherein the turned-back portion has a continuous curvilinear shape.

20. The apparatus of claim 19, wherein an exterior surface of the panel-based siding structure is contacted with an interior-most portion of the turned-back portion of the J-channel portion, wherein an interior surface of the front wall of the J-channel portion is free from contact with the panel-based siding structure.

* * * * *